US007755419B2

(12) United States Patent
Rao et al.

(10) Patent No.: US 7,755,419 B2
(45) Date of Patent: Jul. 13, 2010

(54) LOW POWER BETA MULTIPLIER START-UP CIRCUIT AND METHOD

(75) Inventors: T. V. Chanakya Rao, Bangalore (IN); Badrinarayanan Kothandaraman, Bangalore (IN)

(73) Assignee: Cypress Semiconductor Corporation, San Jose, CA (US)

( * ) Notice: Subject to any disclaimer, the term of this patent is extended or adjusted under 35 U.S.C. 154(b) by 102 days.

(21) Appl. No.: 11/653,533

(22) Filed: Jan. 16, 2007

(65) Prior Publication Data

US 2007/0164722 A1 Jul. 19, 2007

Related U.S. Application Data

(60) Provisional application No. 60/779,154, filed on Mar. 2, 2006.

(51) Int. Cl.
*G05F 1/46* (2006.01)
*G05F 3/26* (2006.01)

(52) U.S. Cl. ..... 327/541; 327/143; 327/543; 323/315

(58) Field of Classification Search ..... None
See application file for complete search history.

(56) References Cited

U.S. PATENT DOCUMENTS 4,769,589 A * 9/1988 Rosenthal ..... 323/313
5,115,146 A 5/1992 McClure
5,159,217 A 10/1992 Mortensen et al.
5,187,389 A 2/1993 Hall et al.
5,212,412 A 5/1993 Atriss et al.
5,237,219 A 8/1993 Cliff
5,243,233 A 9/1993 Cliff
5,347,173 A 9/1994 McAdams
5,386,152 A 1/1995 Naraki
5,394,104 A 2/1995 Lee
5,463,348 A 10/1995 Sarpeshkar et al.
5,477,176 A 12/1995 Chang et al.
5,523,709 A 6/1996 Phillips et al.
5,528,182 A 6/1996 Yokosawa
5,563,799 A 10/1996 Brehmer et al.
5,564,010 A 10/1996 Henry et al.
5,565,811 A 10/1996 Park et al.
5,631,551 A 5/1997 Scaccianoce et al.
5,694,067 A 12/1997 Hull et al.
5,737,612 A * 4/1998 Ansel et al. ..... 713/300
5,801,580 A 9/1998 Wu
5,809,312 A * 9/1998 Ansel et al. ..... 713/300

(Continued)

OTHER PUBLICATIONS

Ben G. Streetman, "Solid State Electronic Devices," Prentence-Hall Inc., 1972, ISBN: 0-13-822023-9; pp. 293, 299, 303; 5 pages.

(Continued)

*Primary Examiner*—Lincoln Donovan
*Assistant Examiner*—Terry L Englund

(57) ABSTRACT

A circuit (200) can include a reference circuit (202) and a start-up circuit (204). A start-up circuit (204) can include a low threshold voltage reference current device (N3) that can pull a start node (210) low in a start-up operation. This can enable activation device (P3), which can place reference circuit (202) in a stable operating mode. Operation of transistor (N3) can be essentially independent of a high power supply voltage and start-up circuit (204) can include no resistors.

13 Claims, 5 Drawing Sheets

U.S. PATENT DOCUMENTS

| | | | | |
|---|---|---|---|---|
| 5,821,787 | A | 10/1998 | McClintock et al. | |
| 5,831,460 | A | 11/1998 | Zhou | |
| 5,844,434 | A | 12/1998 | Eschauzier | |
| 5,850,156 | A | 12/1998 | Wittman | |
| 5,861,771 | A | 1/1999 | Matsuda et al. | |
| 5,952,873 | A | 9/1999 | Rincon-Mora | |
| 5,973,548 | A | 10/1999 | Ukita et al. | |
| 6,016,074 | A | 1/2000 | Yamamori | |
| 6,060,918 | A * | 5/2000 | Tsuchida et al. | 327/143 |
| 6,094,041 | A | 7/2000 | Wachter | |
| 6,118,266 | A | 9/2000 | Manohar et al. | |
| 6,150,872 | A | 11/2000 | McNeill et al. | |
| 6,157,244 | A | 12/2000 | Lee et al. | |
| 6,204,724 | B1 | 3/2001 | Kobatake | |
| 6,229,382 | B1 | 5/2001 | Kojima | |
| 6,259,285 | B1 | 7/2001 | Woods | |
| 6,271,714 | B1 | 8/2001 | Shin | |
| 6,335,614 | B1 | 1/2002 | Ganti | |
| 6,344,771 | B1 | 2/2002 | Tobita | |
| 6,351,111 | B1 * | 2/2002 | Laraia | 323/315 |
| 6,356,064 | B1 * | 3/2002 | Tonda | 323/313 |
| 6,384,670 | B1 | 5/2002 | Eagar et al. | |
| 6,388,479 | B1 * | 5/2002 | Gupta et al. | 327/143 |
| 6,437,614 | B1 | 8/2002 | Chen | |
| 6,469,551 | B2 | 10/2002 | Kobayashi et al. | |
| 6,515,524 | B1 | 2/2003 | Sterrantino et al. | |
| 6,618,312 | B2 | 9/2003 | Cheung et al. | |
| 6,670,845 | B1 | 12/2003 | Fong | |
| 6,677,787 | B1 | 1/2004 | Kumar et al. | |
| 6,677,810 | B2 * | 1/2004 | Fukui | 327/541 |
| 6,731,143 | B2 | 5/2004 | Kim | |
| 6,870,421 | B2 | 3/2005 | Abe | |
| 6,879,194 | B1 | 4/2005 | Caldwell | |
| 6,989,659 | B2 | 1/2006 | Menegoli et al. | |
| 7,030,668 | B1 | 4/2006 | Edwards | |
| 7,049,865 | B2 | 5/2006 | Parker et al. | |
| 7,078,944 | B1 * | 7/2006 | Jenkins | 327/143 |
| 7,119,527 | B2 | 10/2006 | Fernald | |
| 7,123,062 | B2 | 10/2006 | Do | |
| 7,126,391 | B1 * | 10/2006 | Smith et al. | 327/143 |
| 7,135,913 | B2 | 11/2006 | Min et al. | |
| 7,142,044 | B2 | 11/2006 | Sano | |
| 7,205,682 | B2 | 4/2007 | Kuramori | |
| 7,342,439 | B2 * | 3/2008 | Hsiao | 327/538 |
| 7,482,847 | B2 | 1/2009 | Suzuki | |
| 7,504,867 | B2 | 3/2009 | Choi et al. | |
| 7,525,294 | B2 | 4/2009 | Messager | |
| 7,535,286 | B2 * | 5/2009 | Shimada | 327/543 |
| 2004/0189357 | A1 | 9/2004 | Kang et al. | |
| 2005/0140406 | A1 | 6/2005 | Rizzo et al. | |
| 2006/0001099 | A1 | 1/2006 | Motz | |
| 2006/0181315 | A1 * | 8/2006 | Choi et al. | 327/108 |
| 2007/0164791 | A1 * | 7/2007 | Rao et al. | 327/77 |
| 2007/0164812 | A1 * | 7/2007 | Rao et al. | 327/543 |

OTHER PUBLICATIONS

USPTO Notice of Allowance for U.S. Appl. No. 10/857,039 dated Mar. 6, 2006; 4 pages.
USPTO Final Rejection for U.S. Appl. No. 10/857,039 dated Jan. 13, 2006; 5 pages.
USPTO Non-Final Rejection for U.S. Appl. No. 10/857,039 dated Sep. 14, 2005; 5 pages.
USPTO Miscellaneous Action for U.S. Appl. No. 10/857,039 dated Jun. 30, 2005; 3 pages.
USPTO Advisory Action for U.S. Appl. No. 10/857,039 dated Jun. 17, 2005; 4 pages.
USPTO Final Rejection for U.S. Appl. No. 10/857,039 dated Apr. 11, 2005; 5 pages.
USPTO Final Rejection for U.S. Appl. No. 10/857,039 dated Nov. 29, 2004; 4 pages.
USPTO Notice of Allowance for U.S. Appl. No. 10/889,245 dated Jun. 29, 2006; 6 pages.
USPTO Notice of Allowance for U.S. Appl. No. 11/653,532 dated Sep. 3, 2009; 6 pages.
USPTO Final Rejection for U.S. Appl. No. 11/653,532 dated May 18, 2009; 13 pages.
USPTO Non-Final Rejection for U.S. Appl. No. 11/653,532 dated Dec. 12, 2008; 11 pages.
USPTO Non-Final Rejection for U.S. Appl. No. 11/653,532 dated Apr. 29, 2008; 17 pages.
USPTO Non-Final Rejection for U.S. Appl. No. 11/653,540 dated Aug. 25, 2008; 12 pages.
USPTO Notice of Allowance for U.S. Appl. No. 09/532,582 dated Aug. 30, 2001; 1 page.
USPTO Advisory Action for U.S. Appl. No. 09/532,582 dated Aug. 6, 2001; 1 page.
USPTO Final Rejection for U.S. Appl. No. 09/532,582 dated Jul. 16, 2001; 5 pages.
USPTO Non-Final Rejection for U.S. Appl. No. 09/532,582 dated Feb. 28, 2001; 6 pages.
USPTO Notice of Allowance for U.S. Appl. No. 08/920,124 dated Apr. 14, 1998; 3 pages.
USPTO Notice of Allowance for U.S. Appl. No. 08/316,121 dated Sep. 16, 1997; 1 page.
USPTO Advisory Action for U.S. Appl. No. 08/316,121 dated Aug. 14, 1997; 1 page.
USPTO Final Rejection for U.S. Appl. No. 08/316,121 dated Apr. 25, 1997; 6 pages.
USPTO Non-Final Rejection for U.S. Appl. No. 08/316,121 dated Aug. 29, 1996; 9 pages.
USPTO Non-Final Rejection for U.S. Appl. No. 08/316,121 dated Jan. 26, 1996; 6 pages.
USPTO Notice of Allowance for U.S. Appl. No. 11/653,532 dated Dec. 22, 2009; 7 pages.

* cited by examiner

LOW POWER BETA MULTIPLIER START-UP CIRCUIT AND METHOD

This application claims the benefit of U.S. Provisional Patent Application Ser. No. 60/779,154 filed on Mar. 2, 2006, the contents of which are incorporated by reference herein.

TECHNICAL FIELD

The present invention relates generally to integrated circuit devices that include self-biased voltage or current reference circuits, and more particularly to start-up circuits that place such reference circuits into an operational mode in the event of a start-up condition.

BACKGROUND OF THE INVENTION

In many integrated circuit designs it can be desirable to provide a reference circuit. A reference circuit can provide a current and/or voltage at a generally known value. Reference circuits can have numerous applications, including but not limited to establishing a reference voltage to detect input signal levels, establishing a lower supply voltage to some section of a larger integrated circuit (e.g., memory cell array), establishing a reference voltage/current to determine the logic value stored in a memory cell, or establishing a threshold voltage for some other functions.

Reference circuits can be non-biased or self-biased. Non-biased reference circuits can rely on discrete voltage drop devices to arrive at a reference level. For example, a non-biased reference circuit can include resistor-diode (or diode connected transistor) arranged in series between a high supply voltage and a low supply voltage. A drawback to such approaches can be that a current drawn can be proportional to supply voltage. Thus, a higher supply voltage can result in a higher device current (ICC). This can be undesirable for low power applications.

Self-biased reference circuits can rely on transistor biasing to provide a reference current that is less variable (or essentially not variable) in response to changes in power supply voltage. Self-biased reference circuits almost always operate in conjunction with a start-up circuit. A start-up circuit can help establish potentials at particular nodes in a power-up (or similar operation) in order to ensure that the reference circuit is operating properly.

To better understand various features of the present invention, a conventional self-biased reference circuit with corresponding start-up circuitry will now be described.

FIG. 5 shows a first conventional self-biased referenced circuit 500 and corresponding start-up circuit 502. Self-biased referenced circuit 500 can be a "beta-multiplier" reference circuit that includes a first current mirror formed by p-channel metal-oxide-semiconductor (PMOS) transistors P51 and P52, a second current mirror formed by n-channel MOS (NMOS) transistors N51 and N52, and a resistor R51. Transistor N52 can be scaled in size with respect to transistor N51. For example, transistors N51 and N52 can have the same channel lengths, but a width of transistor N52 may be "K" times that of N51, where K is greater than one. In this way, a beta multiplication can occur.

Self-biased reference circuit 500 can include a bias node 504 formed at the drain-drain connection between transistors P51 and N51. When a bias node 504 reaches a predetermined potential, a self-biased reference circuit 500 can reach a stable operating point and provide a reference voltage/current for use in a larger integrated circuit.

A start-up circuit 502 can place bias node 504 at a stable operating point in a start-up operation. A start-up circuit 502 can include a PMOS current supply transistor P53, a PMOS pull-up transistor P54, a current mirror formed by NMOS transistors N53 and N54, and a resistor R52.

The circuit of FIG. 5 operates as follows. The circuit can be placed in an off condition by placing a bias node (biasp) of current mirror P51/P52 to a high supply voltage Vcch, and placing a bias node (biasn) of current mirror N51/N52 to a low supply voltage Vgnd. In such an arrangement, current through transistor P53 can be essentially zero.

In a start-up operation, a node ("Start" at the gate of transistor P54) can discharge toward a low supply voltage Vgnd through transistor N54. This can turn on transistor P54, which can then charge node biasn towards high supply voltage Vcch. Once node biasn reaches $V_{tn}$ (the threshold voltage of transistors N51/N52), node biasp can begin discharging toward the low power supply voltage Vgnd. Once nodes biasp & biasn reach stable values, current supplied by transistor P53 can begin dominating that drawn by transistor N54, and node Start can be pulled to a high power supply voltage Vcch, thereby turning off transistor P54 and ending the start-up operation.

The circuit of FIG. 5 can be conceptualized as comparing a current drawn by self-biased reference circuit Ibeta (i.e., a beta multiplier current) with reference current Iref (that drawn by transistor N53). If a beta multiplier current is less than the reference current (through transistor N54), it can turn on the start-up circuit. In such an arrangement, a beta multiplier current Ibeta can be independent of the level of a power supply voltage Vcch. However, reference current Iref remains dependent on the level of power supply voltage Vcch.

A drawback to a conventional circuit like that shown in FIG. 5 can be lack of flexibility and large circuit components needed for implementation. In particular, if the circuit of FIG. 5 is optimized for use at higher external voltage levels and fast transistor speeds (fast "corners"), at lower voltages and lower transistor speeds (due to manufacturing variations, for example), the conventional circuit can fail to meet a minimum needed start-up time. Further, to arrive at a small reference current Iref, relatively large resistor R52 is needed. For example, achieving a 30 nA reference current at a supply voltage Vcch of 6.0 V can require 200M ohms of resistance. Such a large resistance can consume undesirably large amounts of area in an integrated circuit.

Two other conventional self-biased reference circuits are shown in FIGS. 6A and 6B. These circuits can include some of the same circuit components as that of circuit 500 in FIG. 5. Accordingly, like components are referred to by the same general reference characters.

The circuit 600 of FIG. 6A differs from the circuit of 500 in that an NMOS start-up transistor N65 can be included that is "diode" connected between the nodes biasp and biasn. The circuit 650 of FIG. 6B differs from the circuit of 500 in that two NMOS start-up transistors N66 and N67 can be connected in series between nodes biasp and biasn. The circuit of FIG. 6B is aimed at higher power supply voltages than that of FIG. 6A. In both arrangements, the circuit can be initially off by driving node biasp to a high supply voltage Vcch and node biasn to a low supply voltage Vgnd.

In a start-up operation, the start-up transistor(s) (N65 or N66/N67) can discharge node biasp toward node biasn. Once the nodes reach a stable level the path created by the start-up transistor(s) can be disabled, and the circuit can operate in a self-biased fashion.

A drawback to the circuits of FIGS. 6A and 6B can also be lack of flexibility. In the case of circuit 600, if Vcch>2*Vtn+

Vtp, transistor N65 can start leaking. This can undesirably change the potentials nodes biasp and/or biasn, thus introducing instability into the generated reference current/voltage. It is understood that Vtn is a threshold voltage for NMOS transistors of the circuit while Vtp is a threshold voltage for PMOS transistors of the circuit.

In the case of circuit 650 shown in FIG. 6B, if Vcch<3*Vtn+Vtp, transistors N66/N67 can fail to start-up the circuit (i.e., establish stable bias voltages at nodes biasp and biasn).

Accordingly, if a circuit 650 is optimized for a higher power supply voltage, such a circuit may fail to start-up properly at a lower voltage. At the same time, if a circuit 600 is optimized for low voltages, it may become unstable at high voltages.

It would be desirable to arrive at a self-biased reference circuit that can operate at a wider range of power supply voltages without the drawback of the above conventional approaches.

It would also be desirable to arrive at a self-biased reference circuit that can operate at low current levels and yet not require large resistors.

DETAILED DESCRIPTION

Various embodiments of the present invention will now be described in detail with reference to a number of drawings. The embodiments show circuits and methods for a self-biased reference circuit and corresponding start-up circuit that can operate over a wide range of power supply voltages. Further, a start-up circuit can be composed entirely of transistors, thus eliminating the need for large resistors.

Figure 1:
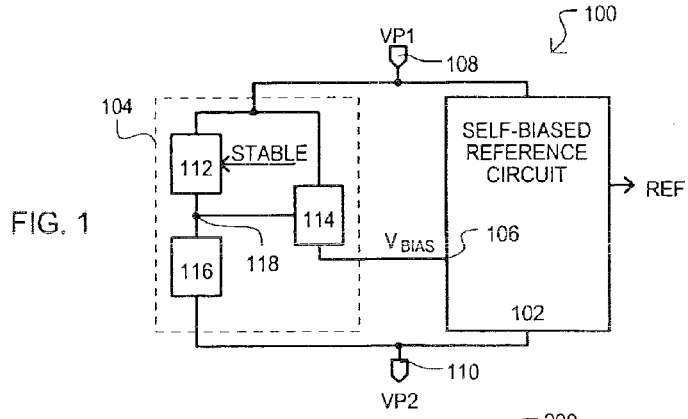
FIG. 1 is a block schematic diagram of a circuit according to a first embodiment of the present invention.

A circuit according to a first embodiment is set forth in FIG. 1, and designated by the general reference character 100. A circuit 100 can include a reference circuit 102 and a start-up circuit 104. A reference circuit 102 can be a self-biased reference circuit that can provide one or more reference values (e.g., current or voltage) REF based on a bias potential $V_{BIAS}$ received at a bias input 106. A reference circuit 102 can be connected between a first power supply node 108 that receives a first power supply voltage VP1, and a second power supply node 110 that receives a second power supply voltage VP2.

A start-up circuit 104 can provide a bias potential VBIAS to reference circuit 102 and can also be connected between power supply voltages VP1 and VP2. A start-up circuit 104 can include a current supply section 112, a bias section 114, and a reference current section 116. A bias section 114 can provide a current at the start of a startup operation, and can then stop such a current once a stable bias potential $V_{BIASIN}$ has been established.

A bias section 114 can establish a bias potential for reference circuit 102 to place such a circuit at a stable operating point. In the particular arrangement shown, a bias section 114 can generate a bias voltage by creating a current path to a power supply voltage VP1. In addition, a bias section 114 can be controlled according to a potential at a start node 118.

A reference current section 116 can be connected between a start node 118 and a power supply voltage VP2. A reference current section 116 can provide a controllable current path between the start node 118 and power supply voltage VP2 that is not dependent upon a potential difference between supply voltages VP1 and VP2. For example, a reference current section 116 can be enabled when little or no potential difference exists across the section. As will be described in other embodiments below, in very particular examples, a reference current section 116 can include a device enabled at about the power supply voltage VP2, more particularly a transistor having a threshold voltage at about the power supply voltage VP2, even more particularly an n-channel transistor with a threshold voltage less than other n-channel transistors, and even more particularly a transistor having a threshold voltage of about 0 volts.

In a start-up operation, due to reference current section 116, start node 118 can be kept at or close to power supply voltage VP2. As a result, bias section 114 can be enabled, and a bias voltage can be provided to reference circuit 102.

Once a bias voltage $V_{BIAS}$ reaches a predetermined level (e.g., reference circuit 102 is operating as desired), current supply section 112 can be enabled, thereby turning off bias section 114, and completing a start-up operation.

Figure 2:
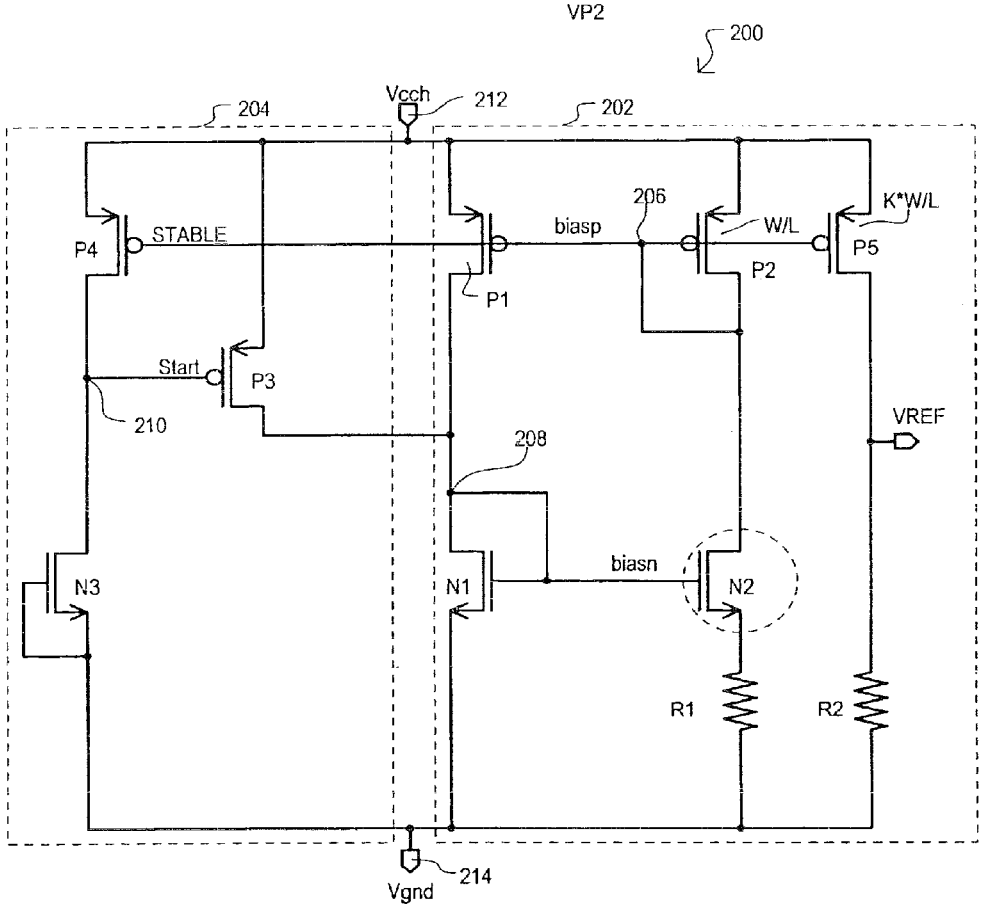
FIG. 2 is a schematic diagram of a circuit according to a second embodiment of the present invention.

A second, more detailed embodiment of the present invention is shown in FIG. 2.

A second embodiment circuit 200 can include a self-biased reference circuit 202 and a corresponding start-up circuit 204. A self-biased referenced 202 circuit can include a "beta multiplier" circuit that includes a first current mirror formed by p-channel insulated gate field effect transistors (IGFETs) P1/P2, a second current mirror formed by n-channel IGFETs N1/N2, and a replica leg formed by p-channel IGFET P3 and resistor R2. First current mirror P1/P2 can include transistors P1 and P2 having source-drain paths arranged in parallel to one another with sources commonly coupled to a high power supply node 212, and gates coupled together. A gate of transistor P2 can be coupled to its drain. Second current mirror N1/N2 can include transistors N1 and N2 having gates coupled together. A gate of transistor N1 can be coupled to its drain and to a bias node 208. A resistor R1 can be coupled between a source of transistor N2 and low power supply node 214 and a source of transistor N1 can be coupled to lower power supply node 214.

A transistor N2 can be a low threshold voltage transistor, as described below, with respect to transistor N3.

A replica leg can include transistor P5 having a source coupled to high power supply node 212 and a gate coupled to bias node 206. A resistor R2 can be connected between a drain of transistor P5 and a low power supply node 214.

A self-biased reference circuit 202 can be placed in a disabled mode by driving a bias node 208 to a low supply potential (e.g., Vgnd), and driving a second bias node 206 to a high supply potential (e.g., Vcch), thus turning off transistors of both current mirrors.

A self-biased reference circuit 202 can be placed in an operational mode by driving a bias node 208 to a stable potential between Vcch and Vgnd, while second bias node 206 can be isolated from a high power supply voltage (Vcch).

In the particular arrangement shown, transistor P2 can have width/length dimensions of W/L and transistor P3 can be scaled in size with respect to transistor P2 by a factor of "K". In such an arrangement, a reference voltage (VREF) generated at the drain of transistor P3 can be given by the relationship:

$$VREF=[Vtn-Vtnat]*R1/R2$$

where Vtn is a threshold voltage of n-channel transistor N1, Vtnat is a low threshold voltage of transistor N2, R1 is a resistance of resistor R1, and R2 is a resistance of resistor R2.

A start-up circuit 204 can include a p-channel current supply transistor P4, a p-channel activation transistor P3, and a current reference transistor N3. In such an arrangement, transistors P4 and N3 can form a start-up current path. In one embodiment, the transistor P4 is an IGFET. In one embodiment, the transistor N3 is an IGFET.

A current supply transistor P4 can have a source-drain path coupled between a high power supply node 212 and a start node 210, and a gate coupled to second bias node 206 within self-biased current reference circuit 202. An activation transistor P3 can have a source-drain path coupled between a high power supply node 212 and bias node 208, and a gate coupled to start node 210.

A current reference transistor N3 can have a source-drain path coupled between start node 210 and a low power supply node 214 and a gate coupled to its source. A current reference transistor N3 can have a lower threshold voltage than other n-channel transistors of the circuit 200. Even more particularly, a current reference transistor N3 can act as a reference current source, with a current drawn by the transistor being compared with that drawn to transistor P4 to determine when transistor P3 is turned on or off. Preferably, a lower power supply Vgnd can be zero volts (i.e., ground), and a threshold voltage of N3 can be centered about zero volts. Even more preferably, transistor N3 can have threshold voltage that can vary (due to process and operating conditions) between about +100 mV to about −100 mv. Even more preferably, transistor N3 can be a "native" device: a transistor that is not subject to any threshold voltage implant/diffusion steps to raise its threshold voltage.

In operation, upon start-up, once a start node 210 reaches about 100 mV, transistor N3 can operate in either sub-threshold saturation ($V_{GS}<V_{tn}$, $V_{DS}>3*V_T$ (75 mv)) or strong inversion saturation ($V_{GS}>V_{tn}$, $V_{GD}<V_{tn}$ (100 mV)), where $V_{GS}$ is the gate-to-source voltage for transistor N3, $V_{tn}$ is the threshold voltage of transistor N3, $V_{DS}$ is the drain-to-source voltage for transistor N3, and $V_T$ is the "thermal" voltage for the transistor N3.

It is noted that in both regions of operation (sub-threshold and strong inversion saturation), a current provided by transistor N3 can remain independent of the $V_{DS}$ level for the transistor. Thus, the operation of the device is also independent of a high power supply voltage Vcch.

Said in another way, in a start-up operation, the above-described operation of transistor N3 can ensure start node 210 is pulled low and transistor P3 is enabled to establish a stable operating point for self-biased reference circuit 202. Once such a stable operating point has been reached, transistor P4 can dominate current path P4/N3, resulting in transistor P3 being turned off, completing the start-up operation.

It is noted that start-up circuit 204 is preferably composed of only transistors, thus eliminating the need for large resistors. Thus, low power operations can be achieved without large resistors. Further, such a circuit can operate in a wide range of voltages (1.6 V to 6.0 V) and not suffer from slow start-up times as the low (e.g., native) n-channel device can be enabled at a relatively fast speed.

Figure 3:
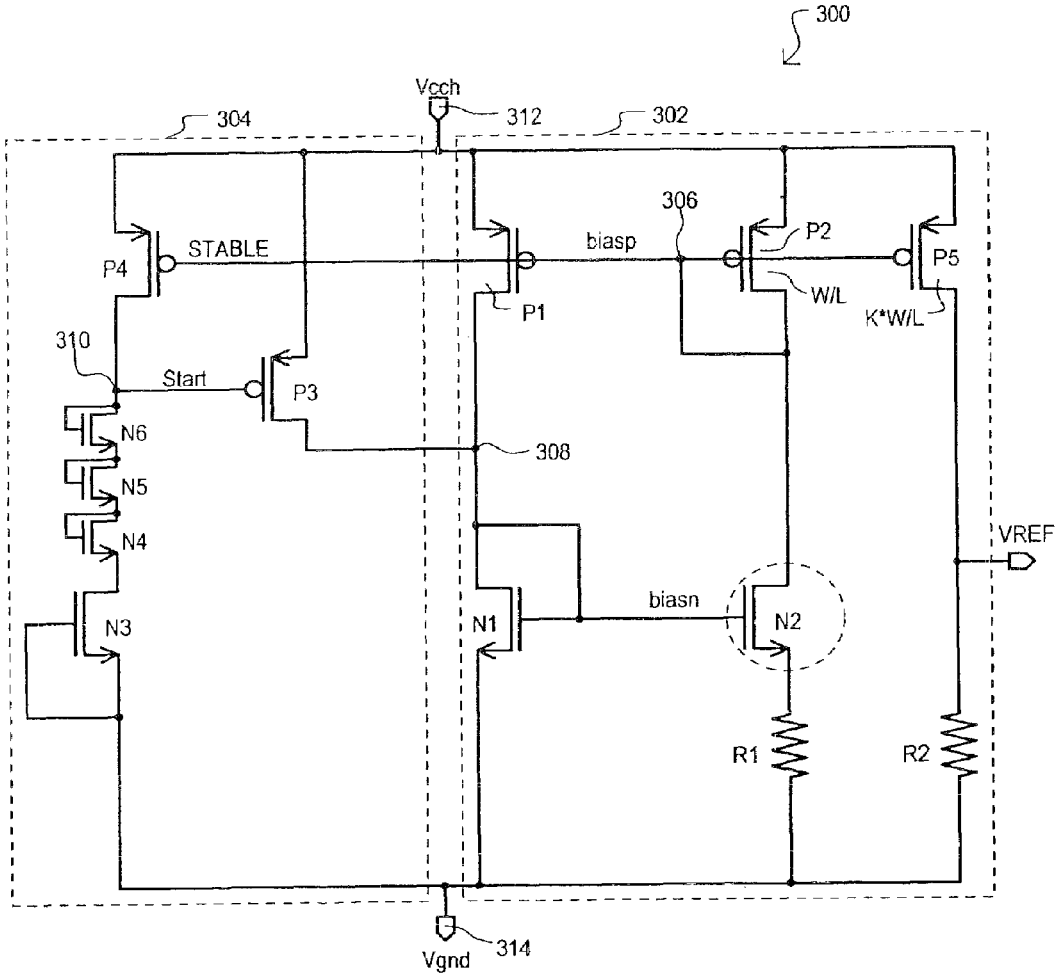
FIG. 3 is a schematic diagram of a circuit according to a third embodiment of the present invention.

While the ability to handle higher power supply voltages can be desirable, in some cases such higher potentials may exceed the maximum voltage limit allowed across transistor terminals. FIG. 3 shows an alternate embodiment for addressing such higher voltage levels.

FIG. 3 shows a third embodiment of the present invention. A third embodiment 300 can include some general components as the embodiment of FIG. 2. Thus, like components can have the same reference character. A third embodiment 300 can differ from that of FIG. 2 in that a series of diode connected transistors N4, N5 and N6 can be connected in series between start node 310 and drain of a "native" transistor N3. In one arrangement, diode connected transistors can also be "native" n-channel transistors. In such an arrangement, if a high power supply voltage (Vcch) is 6.0 V, a drain of transistor N3 can rise to about 4.0 V, protecting transistor N3 from an overvoltage condition. If a high power supply voltage (Vcch) is 1.6 V, a drain of transistor N3 can rise to about 200 mV, thus transistor N3 can still operate as desired (sub-threshold or strong inversion saturation).

As noted above, in particular embodiments, a current supply transistor (or multiple such transistors in the case of FIG. 3) can be "native" device with lower threshold voltages (e.g., at about zero volts). One way in which such devices can be formed can be to isolate such devices from a threshold voltage implant (or diffusion) step. One such arrangement is shown in FIG. 4.

Figure 4:
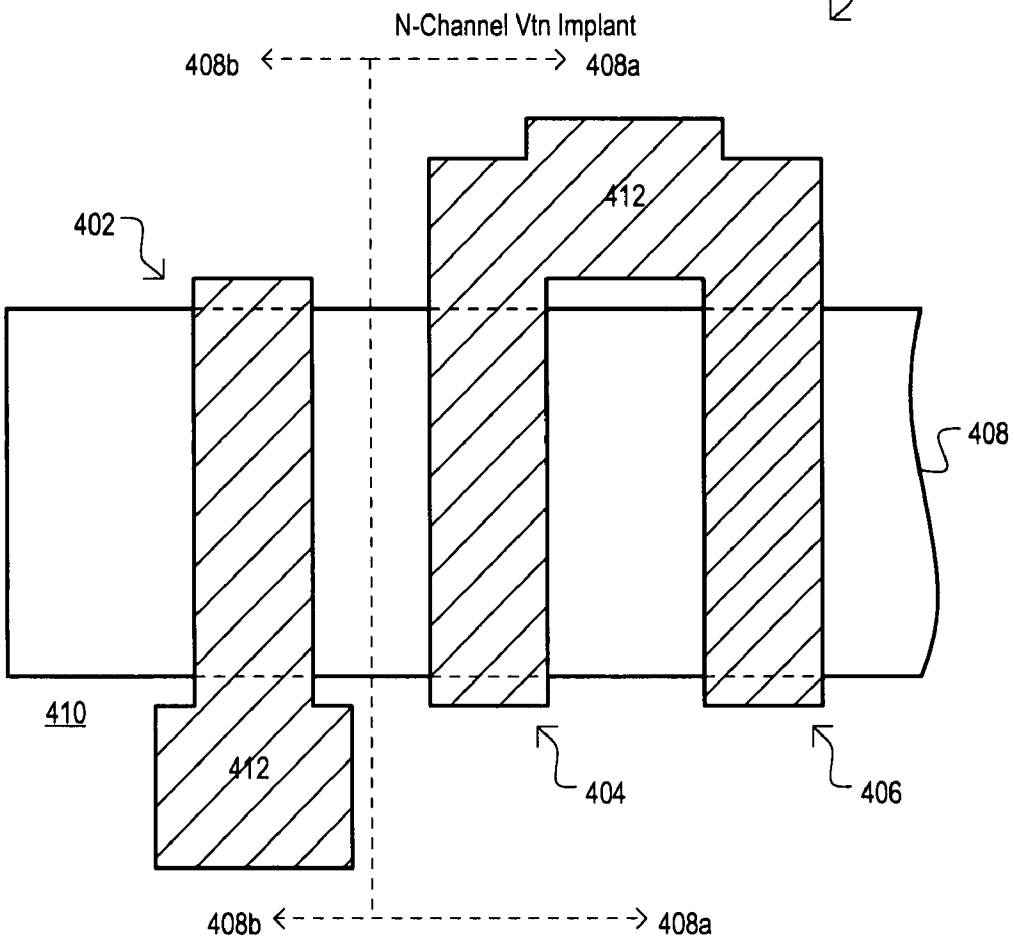
FIG. 4 is a top plan view showing the formation of a "native" transistor that can be used in embodiments of the present invention.
Figure 5:
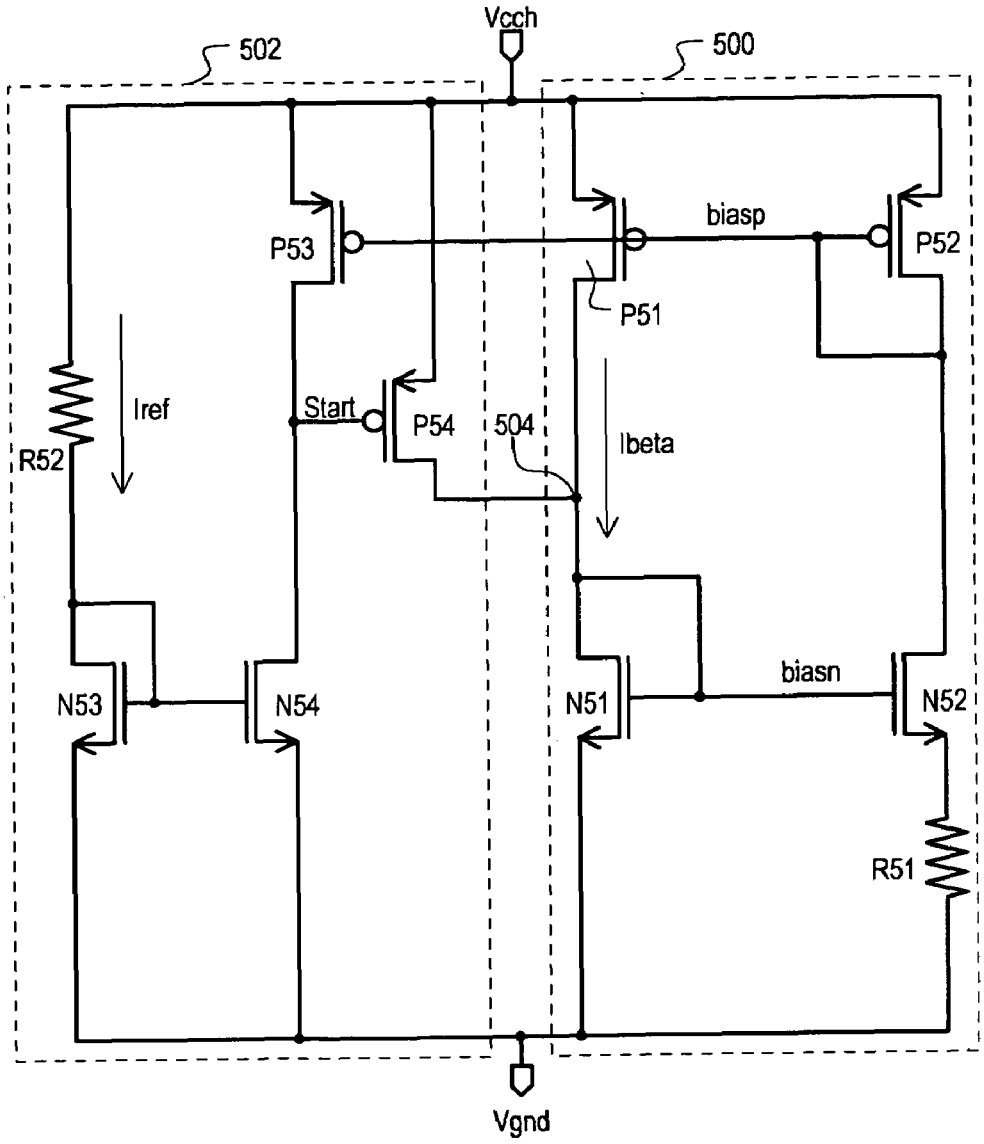
FIG. 5 (BACKGROUND ART)
FIG. 5 is a schematic diagram of a conventional self-biased reference circuit and corresponding start-up circuit.
Figure 6A:
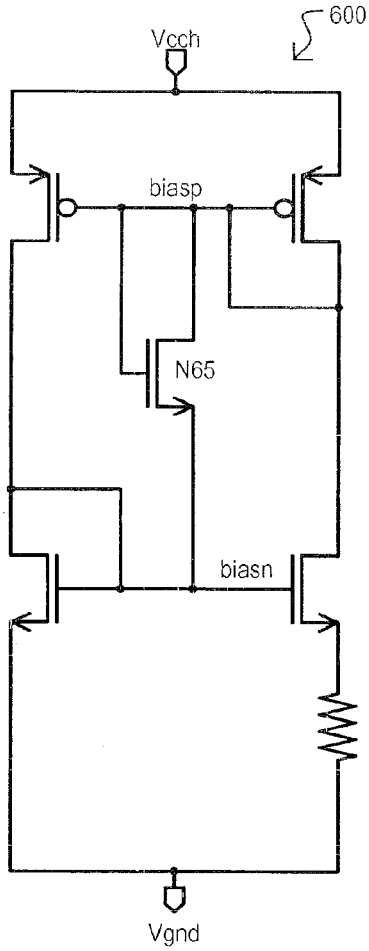
FIG. 6A (BACKGROUND ART)
FIGS. 6A and 6B are schematic diagrams of two more conventional self-biased reference circuits, each optimized for different power supply levels.
Figure 6B:
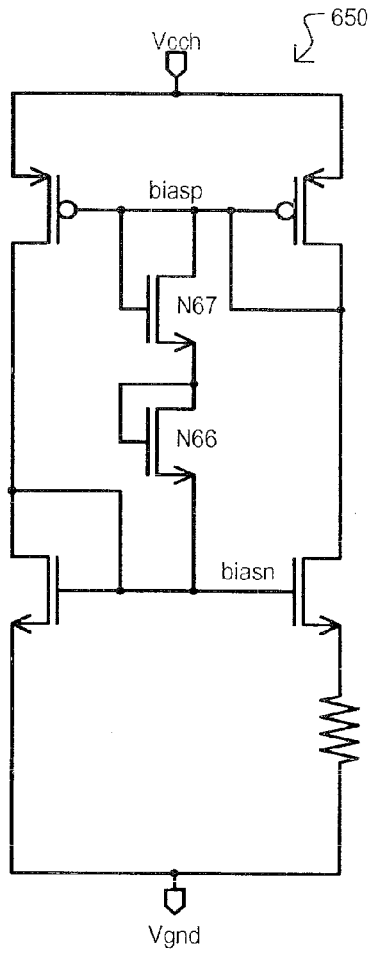
FIG. 6B (BACKGROUND ART)

FIG. 4 is top plan view of n-channel transistors at a gate level. A layout 400 can include a "native" device 402 and two "standard" devices 404 and 406 formed in an active area 408 surrounded by isolation 410.

One portion 408*a* of active area 408 can be subject to a threshold implant step that can raise a threshold voltage of transistors 404 and 406 (prior to the formation of gates 412 and/or sources/drains). Another portion 408*b* of active area 408 can be isolated from such a manufacturing step.

Of course, native devices can be formed in their own active areas, and need not share an area with other non-native devices.

It is understood that the embodiments of the invention may be practiced in the absence of an element and or step not specifically disclosed. That is, an inventive feature of the invention can be elimination of an element.

Accordingly, while the various aspects of the particular embodiments set forth herein have been described in detail, the present invention could be subject to various changes, substitutions, and alterations without departing from the spirit and scope of the invention.

What is claimed is:

1. An integrated circuit device, comprising:

a self-biased reference circuit that provides a reference value to the integrated circuit device, the reference circuit being disposed between a first power supply node and a second power supply node that receives a power supply voltage of about zero volts, the reference circuit including a first current mirror coupled to the first power supply node and comprising a pair of first transistors of a first conductivity type; and a second current mirror coupled between the first current mirror and the second power supply node and comprising a pair of second transistors of a second conductivity type, the pair of second transistors having different threshold voltage values from one another;

a start-up circuit comprising;

a start-up current path coupled between the first power supply node and the second power supply node, the start-up current path comprising:

a reference current transistor having a threshold voltage that is closer in magnitude to the power supply voltage than the first transistors and the second transistors and is in a range of about −100 millivolts to about +100 millivolts, wherein the reference current transistor has its gate electrically coupled to its source;

a current supply transistor coupled to the reference current transistor; and an activation device coupled between the first power supply node and the self-biased reference circuit that is enabled in response to a potential established by the reference current transistor, wherein a current drawn by the reference current transistor is compared to a current supplied by the current supply transistor to determine when the activation device is enabled.

2. The integrated circuit device of claim 1, wherein:

the pair of first transistors are p-channel insulated gate field effect transistors (IGFETs), and the pair of second transistors are n-channel IGFETs.

3. The integrated circuit device of claim 1, wherein:

the second current mirror has a mirror bias node coupled to gates of the pair of second transistors; and the activation device is coupled to the mirror bias node.

4. The integrated circuit device of claim 1, wherein:

the first current mirror has a mirror bias node coupled to gates of the pair of first transistors; and the current supply transistor is of the first conductivity type and has a source-drain path in series with a source-drain path of the reference current transistor, and a gate that is coupled to the mirror bias node.

5. The integrated circuit device of claim 1, wherein:

the reference current transistor comprises an n-channel insulated gate field effect transistor (IGFET) having its gate and source also coupled to the second power supply node.

6. The integrated circuit device of claim 1, wherein:

the activation device comprises a p-channel insulated gate field effect transistor (IGFET) having a gate coupled to the reference current transistor, a source coupled to the first power supply node, and a drain coupled to the selfbiased reference circuit.

7. The integrated circuit device of claim 1, wherein the first transistors and the second transistors comprise insulated gate field effect transistors (IGFETs).

8. A reference circuit, comprising:

a reference section that provides a reference value for other circuits of an integrated circuit according to a bias voltage at a reference bias node, and includes a first current mirror circuit comprising:

a first n-channel mirror transistor having a gate and drain coupled to the reference bias node and a source coupled to a second power supply node, and a second n-channel mirror transistor having a gate coupled to the gate of the first n-channel mirror transistor, the threshold voltage of the second n-channel mirror transistor being different from that of the first n-channel mirror transistor; and a start-up circuit comprising:

a biasing device having a controllable impedance path between the reference bias node and a first power supply node, a reference current transistor having a drain coupled to the biasing device, wherein the reference current transistor has its gate electrically coupled to its source and wherein the reference current transistor's source and gate are also commonly coupled to the second power supply node, and a p-channel current supply transistor coupled to the reference current transistor, wherein a current drawn by the reference current transistor is compared to a current supplied by the current supply transistor to determine when the biasing device is turned on.

9. The reference circuit of claim 8, wherein:

the reference section further comprises p-channel transistors and wherein the first and second n-channel mirror transistors have different predetermined n-channel threshold voltages; and the reference current transistor has a lower threshold voltage than the predetermined threshold voltages of the first and second n-channel mirror transistors.

10. The reference circuit of claim 8, wherein:

at least one of the first and second n-channel mirror transistors is formed in an area defined by a threshold voltage adjustment implant mask; and the reference current transistor is not formed in the area defined by the threshold voltage adjustment implant mask.

11. The reference circuit of claim 8, wherein:

the biasing device comprises a p-channel bias transistor having a source-drain path coupled between the reference bias node and the first power supply node, the reference current transistor comprises a drain coupled to the gate of the bias transistor, and the p-channel current supply transistor has a source-drain path coupled between the first power supply node and the drain of the reference current transistor, and a gate coupled to the reference section.

12. The reference circuit of claim 11, wherein the reference section further includes a second current mirror circuit comprising:

a first p-channel mirror transistor having a gate coupled to the gate of the p-channel current supply transistor and a source-drain path coupled between the first power supply node and the reference bias node, and a second p-channel mirror transistor having a source coupled to the first power supply node and a gate and drain coupled to the gate of the first p-channel mirror transistor.

13. A reference circuit, comprising:

a reference section that provides a reference value for other circuits of an integrated circuit according to a bias voltage at a reference bias node, and includes a p-channel current mirror, and an n-channel current mirror circuit comprising:

a first n-channel mirror transistor having a gate and drain coupled to the reference bias node and a source coupled to a second power supply node, the first n-channel mirror transistor formed in an area defined by a threshold voltage adjustment implant mask, a second n-channel mirror transistor having a gate coupled to the gate of the first n-channel mirror transistor, the threshold voltage of the second n-channel mirror transistor being different from that of the first n-channel mirror transistor;

a start-up circuit comprising:

a p-channel biasing transistor having a controllable impedance source-drain path coupled between the reference bias node and a first power supply node, a reference current transistor having a drain coupled to a gate of the biasing transistor, a gate electrically coupled to its source, the source and gate of the reference current transistor also commonly coupled to the second power supply node, wherein the reference current transistor is formed in an area other than the area defined by the threshold voltage adjustment implant mask and has a lower threshold voltage than the threshold voltage of the first n-channel mirror transistor; and a p-channel current supply transistor having a source-drain path coupled between the first power supply node and the drain of the reference current transistor, and having a gate coupled to the reference section, wherein a current drawn by the reference current transistor is compared to a current supplied by the current supply transistor to determine when the biasing transistor is turned on.

* * * * *